US005598667A

United States Patent [19]

Dykes

[11] Patent Number: 5,598,667

[45] Date of Patent: Feb. 4, 1997

[54] PANEL COVER SYSTEM AND METHOD

[76] Inventor: Gary M. Dykes, 523 W. 8th., Larned, Kans. 67550

[21] Appl. No.: 425,878

[22] Filed: Apr. 21, 1995

[51] Int. Cl.[6] ..... E04C 2/32

[52] U.S. Cl. ..... 52/71; 52/316; 52/509; 52/512; 52/716.8; 52/789.1; 160/236

[58] Field of Search ..... 52/38, 287.1, 288.1, 52/385, 71, 506.01, 506.05, 508, 509, 716.8, 718.01, 783.12, 784.1, 797.1, 800.12, 800.13, 800.18, 802.11; 160/199, 201, 229.1, 236; 40/490, 575, 649

[56] References Cited

U.S. PATENT DOCUMENTS

| | | | |
|---|---|---|---|
| 741,524 | 10/1903 | Miller | 52/288.1 X |
| 2,356,332 | 8/1944 | Malmer | 40/649 |
| 2,928,462 | 3/1960 | Neisewander | 160/229.1 |
| 3,104,699 | 9/1963 | Wolf et al. | 52/783.12 X |
| 3,121,977 | 2/1964 | Bersudsky | 52/506.01 X |
| 3,218,772 | 11/1965 | Martin | 52/508 |
| 3,611,664 | 10/1971 | Barbera | 52/481.1 |
| 4,494,354 | 1/1985 | Johnston | 52/783.12 X |
| 4,828,004 | 5/1989 | Martinez et al. | 160/201 X |
| 5,088,252 | 2/1992 | Autekeier | 52/287.1 X |

FOREIGN PATENT DOCUMENTS

| | | | |
|---|---|---|---|
| 136954 | 4/1985 | European Pat. Off. | 428/598 |

*Primary Examiner*—Michael Safavi
*Assistant Examiner*—Kevin D. Wilkens
*Attorney, Agent, or Firm*—Litman, McMahon and Brown, L.L.C.

[57] ABSTRACT

A panel cover system for covering panels such as those comprising overhead doors. The cover system includes a plurality of covers with longitudinal and side margins for generally being aligned with the door panel longitudinal and side edges. The cover includes a field portion in a first, inner plane and a raised decorative portion in a second, outer plane spaced therefrom. The raised, decorative portion of the cover is bounded by the field portion. The covers are attached to the panels by edge strips extending along the panel longitudinal edges and receiving the cover longitudinal margins. The edge strips have J-shaped cross-sectional configurations.

2 Claims, 2 Drawing Sheets

PANEL COVER SYSTEM AND METHOD

BACKGROUND OF THE INVENTION

1. Field of the Invention

The present invention relates generally to construction finish systems, in particular to a cover system for door panels, and more particularly to a cover system for overhead door panels.

2. Description of the Related Art

A wide variety of finish systems have heretofore been employed in construction to provide a corresponding wide variety of finished appearances on various construction materials and building components. Examples include paint and other coatings, which can be applied to the construction materials forming part of a structure. Various types of siding materials are also commonly employed in construction to achieve desired finished appearances and performances.

Although painting can be an effective method of finishing a structure and providing protection therefor, finish longevity and resistance to the elements can be a problem. Particularly in severe climates, structures may require periodic repainting to maintain their appearances. Other problems with paint relate to its susceptibility to chipping, peeling, etc., and the necessity of adequate, and often extensive, surface preparation prior to applying the paint.

Overhead door panels have also been manufactured of materials such as steel, aluminum and fiberglass, which can be prefinished. However, such prefinished panels are often too expensive for use as replacements for existing painted overhead door panels, and may not be compatible with the finishes of other exterior building materials. Moreover, the finishes of such prefinished door panels are susceptible to deterioration, such as fading, from prolonged exposure to the elements. Still further, metal door panels are susceptible to denting from hail and other objects.

An important objective in the selection of finish materials for construction relates to appearance and the ability to retrofit same to existing structures. Moreover, it can be desirable to coordinate the finishes of such building components as doors, etc. with the siding and trim materials of the structure.

Still further it is desirable to provide a panel cover system in kit form consisting of various components, which can be adapted for application to various sizes and configurations of panels, such as door panels.

Heretofore there has not been available a panel cover system with the advantages and features of the present invention. The panel cover system of the present invention addresses the aforementioned problems with previous cover and finish systems.

SUMMARY OF THE INVENTION

In the practice of the present invention, a cover system is provided for covering the panels of an overhead door. A cover can be provided for every overhead door panel. Each cover includes a field portion in a first plane and a raised panel section located within and surrounded by the field portion. Each raised panel section protrudes outwardly from the field portion a relatively short distance. Each cover includes upper, lower and opposite side margins which are generally located in proximity to respective panel upper, lower and opposite side edges. The covers are mounted on the panels by edge strips which are attached to the panels along the upper and lower edges thereof. The edge strips include base and return flanges forming a channel therebetween for receiving a respective cover upper or lower margin. The edge strips are fastened to the panels by mechanical fasteners extending through the edge strip base flanges and into the panel.

OBJECTS AND ADVANTAGES OF THE INVENTION

The principal objects and advantages of the present invention include providing a panel cover system; providing such a system which is adaptable for various sizes and shapes of panels; providing such a system which is adapted for resurfacing existing overhead doors; providing such a system which is adapted for resurfacing various types of doors; providing such a system which can be relatively quickly and easily installed; providing such a system which requires relatively few tools for installation; providing such a system which can be coordinated with other finished materials of a structure; providing such a system which includes covers fabricated from various materials; providing such a system which utilizes commonly available materials and components for installation; providing such a system wherein the covers can be formed with a variety of designs; and providing such a system which is economical to manufacture, efficient in operation and particularly well-adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
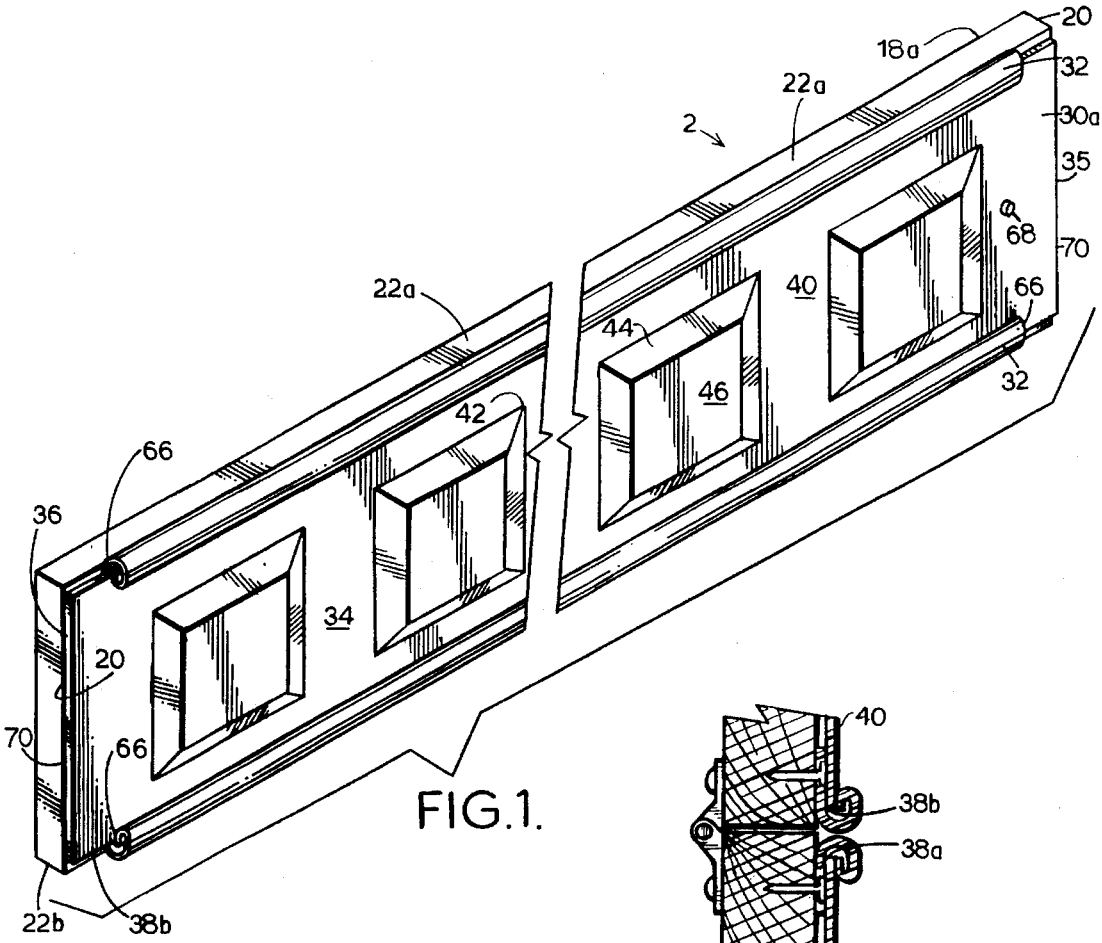
FIG. 1 is a fragmentary, front, upper perspective view of a cover system embodying the present invention, shown mounted on an overhead door panel.
Figure 5:
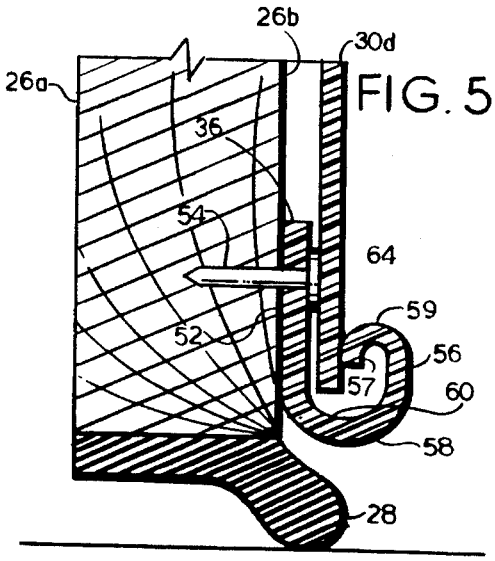
FIG. 5 is an enlarged, fragmentary, vertical cross-sectional view thereof, taken generally within circle 5 in FIG. 4.
Figure 4:
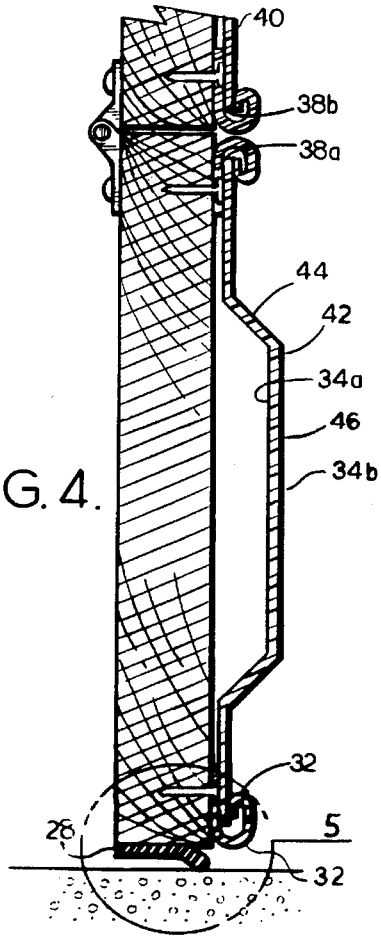
FIG. 4 is an enlarged, fragmentary, vertical cross-sectional view thereof, taken generally along line 4—4 in FIG. 3.
Figure 2:
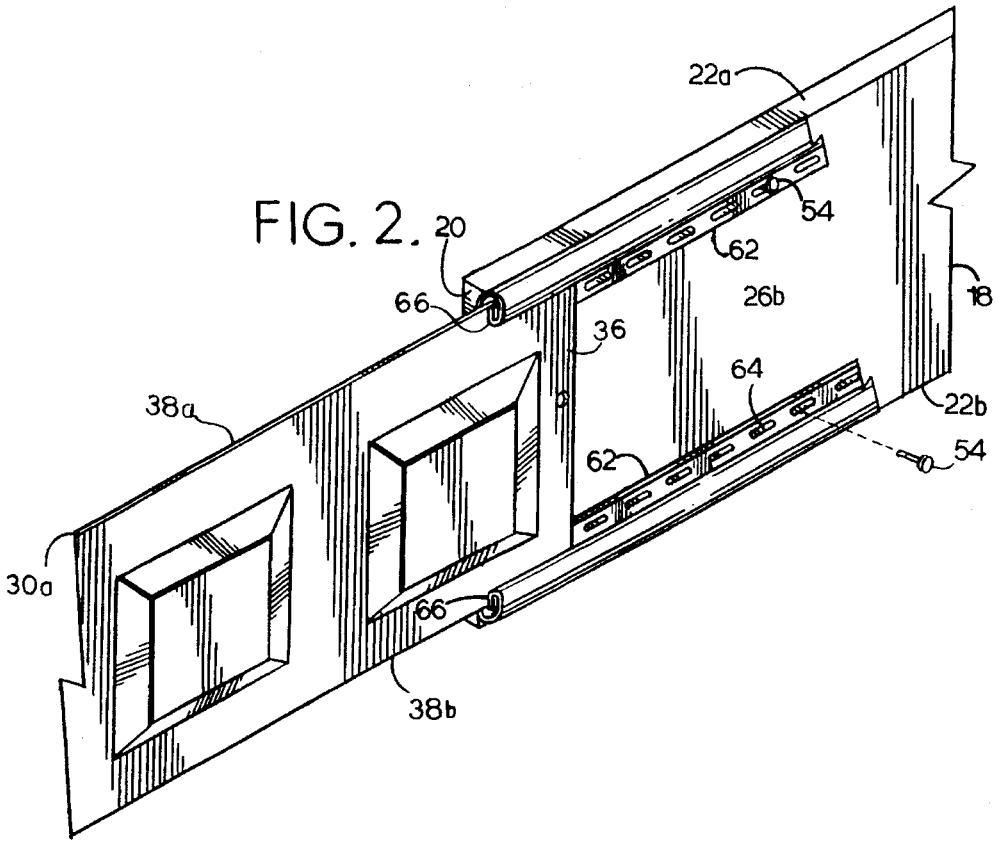
FIG. 2 is a fragmentary, front, upper perspective view thereof, showing a cover thereof being slid into position over a door panel.
Figure 3:
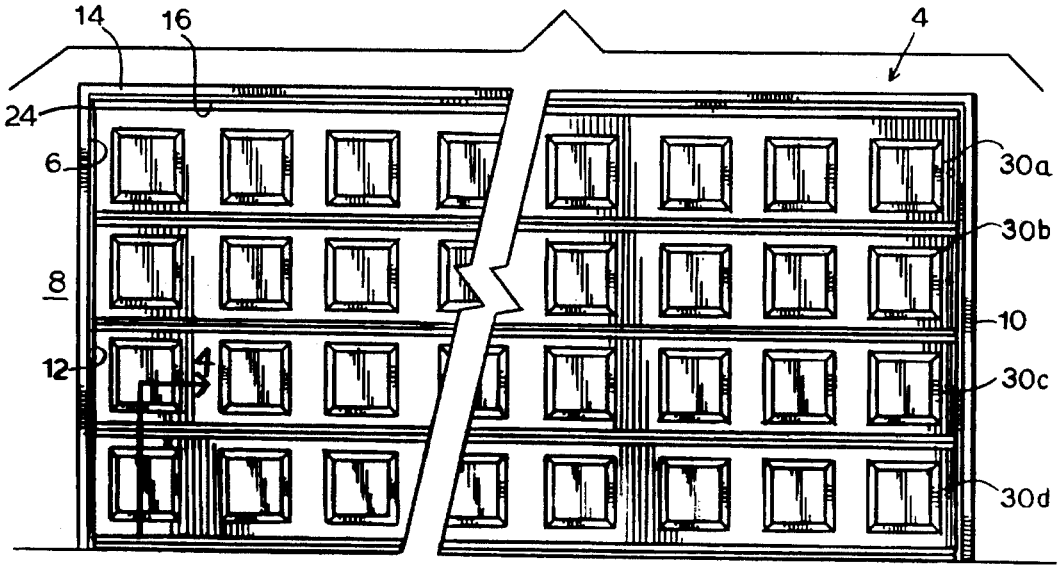
FIG. 3 is a fragmentary, front elevational view thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a panel cover system embodying the present invention. Without limitation on the generality of useful applications for the panel cover system 2, an exemplary application thereof to an existing overhead door structure 4 is shown. The overhead door structure 4 is provided for selectively closing an opening 6 in a wall 8, e.g., for providing a garage door or the like. The opening 6 includes a pair of side jamb assemblies 10, each including a respective jamb weatherstrip gasket 12. The opening also includes a head assembly 14 mounting a head weatherstrip gasket 16.

The door structure 4 includes a plurality of panels 18*a*, 18*b*, 18*c* and 18*d* from top-to-bottom each having opposite side edges 20 and upper and lower longitudinal edges 22*a*, 22*b*. The panels 18*a*–18*d* can have a common width, which can correspond to the width of the opening 6. For example, the door opening 6 can have approximate dimensions of eight feet (width) and seven feet (height) for providing access by a single vehicle. Alternatively, a double-width garage door would generally have a width in the range of about fifteen to sixteen feet. Such door heights and widths tend to be relatively standard in the construction industry, although exact door panel sizes vary from manufacturer to manufacturer and door openings of different sizes are typically required for accommodating the requirements of particular door manufacturers.

Overhead door widths of eight, nine, fifteen and sixteen feet and heights of seven feet are fairly common. However, overhead doors are available with nominal widths of ten, twelve, fourteen, etc. feet and are also available in heights greater than seven feet. Likewise, overhead doors are available with four, five and six panels, and could be manufactured with other numbers of panels. Moreover, overhead doors may comprise single panels.

Adjacent door panels 18*a*–18*d* of the door structure 4 are hingedly interconnected to accommodate folding therebetween as an overhead door 24 formed thereby extends and retracts. The movements of the door panels 18*a*–18*d* can be controlled by tracks, rollers and springs, all of which are well known in the field of overhead doors. Each overhead door panel 18*a*–18*d* includes inner and outer faces 26*a*, 26*b*.

The lower longitudinal edge 22*b* of the lowermost door panel 18*d* mounts a weatherstrip gasket 28 for selective engagement with a floor surface with the overhead door 24 in its closed position. Weathersealing for the overhead door 24 in its closed position is also provided by the jamb and head weatherstrip gaskets 12, 16, which engage outer faces 26*b* of respective door panels 18*a*–18*d*.

The panel cover system 2 generally comprises a plurality of covers 30*a*–30*d* for mounting on respective door panels 18*a*–18*d* in covering relation over same and a plurality of edge strips 32 for mounting the covers 30*a*–30*d*.

II. Covers 30*a*–30*d*

Each cover 30*a*–30*d* includes inner/back and outer/front surfaces 34*a*, 34*b*; a pair of opposite side margins 36 and upper and lower longitudinal margins 38*a*, 38*b*. The cover margins 36, 38*a*, 38*b* define the overall dimensions of a cover field portion 40 which generally lies within a first, inner plane generally flush with a door panel outer face 26*b*. The cover field portions 40 can be sized to accommodate different-sized door panels 18*a*–18*d*, with the covers 30*a*–30*d* preferably being sized to accommodate the largest door panels 18*a*–18*d* likely to be encountered.

Each cover 30*a*–30*d* includes a plurality of raised panel decorative sections 42 each having a border frame 44 and a generally flat, central portion 46 located within said border frame 44. Adjacent raised decorative sections are separated by respective strips of the field portion 40. The border frame and central portion 44, 46 are preferably located approximately in a second, outer plane, which can be positioned up to about 4" outward from the first, inner plane in order to provide clearance for the overhead door 24 with respect to the head assembly 14.

The covers 30*a*–30*d* can comprise any suitable material, such as vinyl, aluminum, painted steel, etc. The material comprising the covers 30*a*–30*d* is preferably relatively thin to minimize its weight, to minimize the necessity of adjusting the door clearance, to minimize material cost and to simplify manufacturing. For example, material thicknesses in the range of about 0.03 to 0.05 inches could be provided for certain materials. The raised decorative sections 42 can be formed therein by a suitable process, such as vacuum forming, roll forming, etc. The covers 30*a*–30*d* can also be premarked with cut line indicia on their inner surfaces.

The raised decorative sections 42 can likewise assume a variety of decorative configurations to accommodate desired aesthetic effects. Moreover, various patterns of raised decorative sections 42 could be provided. The area occupied by the raised panel decorative sections 42 is preferably small enough to accommodate the smallest door panels 18*a*–18*d* to which the covers 30*a*–30*d* are likely to be applied while providing a field portion 40 around the raised panel decorative sections 42.

III. Edge Strips 32

Each cover 30*a*–30*d* is mounted by means of a pair of edge strips 32, each of which includes a base flange 52 mounted on a respective panel outer face 26*b* by suitable mechanical fasteners, such as nails 54, staples, adhesive, etc.

Each edge strip 32 also includes a respective return flange 56 located over a respective base flange 52 and connected thereto by an edge strip fold line 58 forming a longitudinally-extending channel 60 adapted to receive a respective cover longitudinal margin 38*a*, 38*b*. The edge strip fold lines 58 can be located approximately flush with respective door panel longitudinal edges 22*a*, 22*b*. A retainer flange 57 is connected to each return flange 56 along a respective curved free edge 59 and extends slightly under the return flange 56 towards the fold line 58. The curvilinear configuration of the curved free edge 59 facilitates insertion of the cover upper and lower margins 38*a*, 38*b*. The base flange 52 is preferably slightly wider than the return flange 56 whereby a base flange exposed strip 62 is provided for receiving mechanical fasteners, such as nails 54. The base flange exposed strip 62 can be penetrated with suitable fastener receivers 64.

The edge strips 32 can comprise a type of edge stripping which is commercially available and typically used for installing manufactured siding, such as vinyl siding and the like. The edge strips 32 are sometimes referred to as "seal trim" in connection with vinyl siding. Each edge strip 32 includes opposite side ends 66 located in spaced relation from the cover side margins 36. The edge strip side ends 66 are spaced inwardly from the cover side margins 36 to provide clearance for the door opening jamb assemblies 10, and particularly the jamb weatherstrip gaskets 12 thereof which directly engage the covers 30*a*–30*d* in proximity to their respective side margins 36. The edge strips 32 thus terminate at respective opposite side ends 66, which can be located immediately inwardly from respective jamb weatherstrip gaskets 12.

IV. Installation Method and Operation

The panel cover system 2 can be installed on a variety of overhead doors 24. For such applications, a kit consisting of the requisite number of covers 30*a*–30*d* and the requisite number of edge strips 32 and fasteners 54 can be provided. The cover field portions 40 are then cut to appropriate widths and heights to correspond in size generally to the door panels 18*a*–18*d* to be covered. It will be appreciated that the cover longitudinal margins 38*a*, 38*b* can accommodate some variation since they will be received within the edge strip channels 60 and thus concealed. In a typical overhead door structure 4, edge strips need not be provided for the cover side margins 36 since they will be concealed by the jamb weatherstrip gaskets 12 with the door 24 in its closed configuration.

Without limitation on the generality of useful applications of the panel cover system 2, it can be applied to overhead doors, side-pivot doors, etc. The colors, materials and textures of the covers 30*a*–30*d* and the edge strips 32 can be chosen so as to coordinate with other finishes of a structure on which they are installed, e.g., the siding and/or trim material. Contrasting or matching colors could also be used for aesthetic purposes.

With the edge strips 32 suitably mounted, the covers 30*a*–30*d* can be inserted into the edge strips 32 longitudinally and can be slidably received in the channels 60 thereof. Alternatively, the covers 30*a*–30*d* can be installed by inserting a longitudinal margin 38*a* or 38*b* of each of a respective channel 60, whereafter the covers 30*a*–30*d* can be flexed or bent in an outwardly-concave configuration to insert the other longitudinal margins 38*a*, 38*b* into the opposed edge strip channels 60. The covers 30*a*–30*d* can be secured on the panels 18*a*–18*d* by suitable mechanical fasteners 68, such as nails which can be placed in the cover field portions 40 in proximity to a respective side margin 36 of each cover 30*a*–30*d*. The covers 30*a*–30*d* are thus retained in place by the edge strips 32 and by engagement with the jamb weatherstrip gaskets 12, in addition to the nails 68. By providing one mechanical fastener 68 adjacent one of the cover side margins 36, temperature deflection of the covers 30*a*–30*d* can be accommodated since one of the ends 70 thereof would be free to slide longitudinally slight amounts to accommodate expansion and contraction caused by temperature changes.

It is to be understood that while certain forms of the present invention have been illustrated and described herein, it is not to be limited to the specific forms or arrangement of parts described and shown.

What is claimed and desired to be secured by Letters Patent is as follows:

1. A cover system mounted on an overhead-type door including a plurality of panels each having inner and outer faces, upper and lower longitudinal edges and opposite side edges, said panels being positioned in juxtaposed relation with adjacent longitudinal edges of respective panels being hingedly interconnected, a lowermost of said panels having a weatherstrip gasket mounted on the lower edge thereof, said overhead door being mounted within a framed opening including a pair of side jamb assemblies and a pair of side weatherstrip gaskets mounted along each side jamb assembly for engaging said panels along their respective side edges, which comprises:

(a) a plurality of panel covers each adapted for mounting on a respective panel and including:
  (1) front and back surfaces;
  (2) upper and lower longitudinal margins;
  (3) first and second side margins;
  (4) a field portion adjacent to said margins and generally lying in a first, inner plane; and
  (5) a plurality of raised panel sections each including a decorative central portion spaced outwardly from the plane of said field, each said panel cover including a plurality of said raised panel sections positioned in side-by-side spaced relationship and separated by said field portion;

(b) a pair of edge strips mounted on each said panel, each said edge strip including:
  (1) a base flange mounted on a respective panel outer face in proximity to a respective longitudinal edge thereof;
  (2) a return flange overlying said base flange;
  (3) a demarcation fold line whereat said base and return flanges are integrally connected to each other and generally parallel with respect to each other;
  (4) a longitudinally extending channel receiving a respective cover longitudinal margin;
  (5) a retainer flange positioned within said channel and located generally between said base and return flanges;
  (6) an access slot to said channel being formed between said retainer and said base flange;
  (7) a curved, free edge formed along a longitudinally-extending intersection of said return flange and said retainer flange; and
  (8) said retainer flange contacting a respective panel cover longitudinal margin for retaining said panel cover against said base flange;

(c) edge strip mounting means for mounting said edge strip base flange to said panel outer face with said edge strip fold line positioned in proximity to a respective panel longitudinal edge and terminating generally at the level thereof;

(d) mounting means for mounting each said cover on a respective panel comprising a mechanical fastener extending through said cover in proximity to a side margin thereof and into said panel in proximity to a side edge thereof; and (e) said field portion having a size adapted to cover and overhang the edges of a panel whereby said cover is adapted for being edge-trimmed to cover a plurality of different-sized door sections.

2. A method of covering a door comprising multiple panels each having upper, lower and opposite side edges, said panels being hingedly interconnected along adjacent longitudinal edges thereof, which comprises the steps of:

(a) providing a cover with a field portion located generally in a first, inner plane and a raised decorative section located in a second, outer plane located outwardly from the first, inner plane;

(b) providing a pair of edge strips on each panel, each said edge strip comprising a base flange and a return flange overlying said base flange, a demarcation fold line whereat said base and return flanges are integrally connected to each other generally parallel with respect to each other, a longitudinally extending channel receiving a respective cover longitudinal margin, a retailer flange positioned within said channel and located generally between said base and return flanges, an access slot to said channel being formed between said retainer and said base flange, a curved free edge formed along a longitudinally extending intersection of said return flange and said retainer, and said retainer flange contacting a respective panel cover longitudinal margin in said access slot and retaining said panel cover longitudinal margin against said base flange, (c) mounting each said edge strip on a respective panel with the fold line thereof in proximity to a respective panel longitudinal edge;

(d) longitudinally slidably inserting said covers by sliding said cover margins thereof within respective edge strip channels;

(e) providing said covers with overall field dimensions sufficient to cover the front faces of a plurality of different-sized panels;

(f) cutting side margins of said covers equally to fit said panels;

(g) cutting longitudinal margins of said covers equally to generally align same with said panel upper and lower edges; and (h) fastening said covers to said panels with mechanical fasteners in said field portions in proximity to respective side margins.

* * * * *